US005730336A

United States Patent [19]

Lerner

[11] Patent Number: 5,730,336

[45] Date of Patent: Mar. 24, 1998

[54] DISPENSING VALVE FOR A FLEXIBLE LIQUID CONTAINER

[75] Inventor: Robert A. Lerner, Albany, Calif.

[73] Assignee: Cascade Designs, Inc., Seattle, Wash.

[21] Appl. No.: 609,510

[22] Filed: Mar. 1, 1996

Related U.S. Application Data

[63] Continuation-in-part of Ser. No. 581,990, Jan. 2, 1996, abandoned.

[51] Int. Cl.[6] ..... B65D 5/72

[52] U.S. Cl. ..... 222/490; 137/849

[58] Field of Search ..... 137/844, 845, 137/849; 222/490, 494

[56] References Cited

U.S. PATENT DOCUMENTS

| | | | |
|---|---|---|---|
| 2,219,604 | 10/1940 | Trotter | 222/490 X |
| 2,623,663 | 12/1952 | Gassaway | 222/490 |
| 3,342,318 | 9/1967 | Ruekberg et al. | 222/490 X |
| 3,391,830 | 7/1968 | Kitchens | 222/490 X |
| 4,728,006 | 3/1988 | Drobish et al. | 137/849 X |
| 4,776,495 | 10/1988 | Vignot | 222/494 X |
| 4,852,781 | 8/1989 | Shurnick et al. | 224/148 |
| 4,941,598 | 7/1990 | Lambelet, Jr. et al. | 222/490 X |
| 4,948,023 | 8/1990 | Tripp | 222/175 X |
| 5,085,349 | 2/1992 | Fawcett | 222/490 X |
| 5,271,531 | 12/1993 | Rohr et al. | 222/490 X |
| 5,390,805 | 2/1995 | Bilani et al. | 137/845 X |

FOREIGN PATENT DOCUMENTS

| | | | |
|---|---|---|---|
| 393956 | 11/1965 | Switzerland | 137/844 |
| 145824 | 6/1962 | U.S.S.R. | 137/849 |
| 23843 | 12/1892 | United Kingdom | 137/844 |
| 1074906 | 7/1967 | United Kingdom | 222/490 |

*Primary Examiner*—Kevin P. Shaver
*Attorney, Agent, or Firm*—Graybeal Jackson Haley LLP

[57] ABSTRACT

A valve for a flexible liquid-container has a hollow cylindrical body including a bowl-shaped or trough-shaped diaphragm, circumferentially sealed to an inside wall of the tubular body. A convex side of the diaphragm faces an inlet side of the valve and a concave surface of the diaphragm faces an outlet side of the valve. The diaphragm has at least one slit extending therethrough. A cylindrical tube-spring of elliptical cross-section inserted into the tubular body exerts tension on the slit for holding the slit closed when the valve is not in use.

16 Claims, 4 Drawing Sheets

FIG. 1
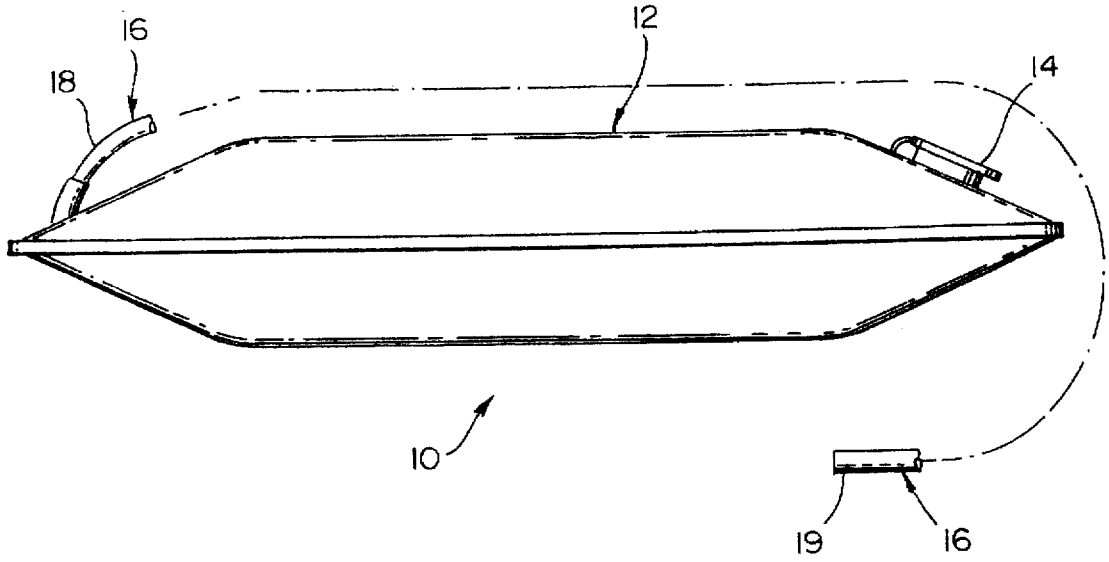
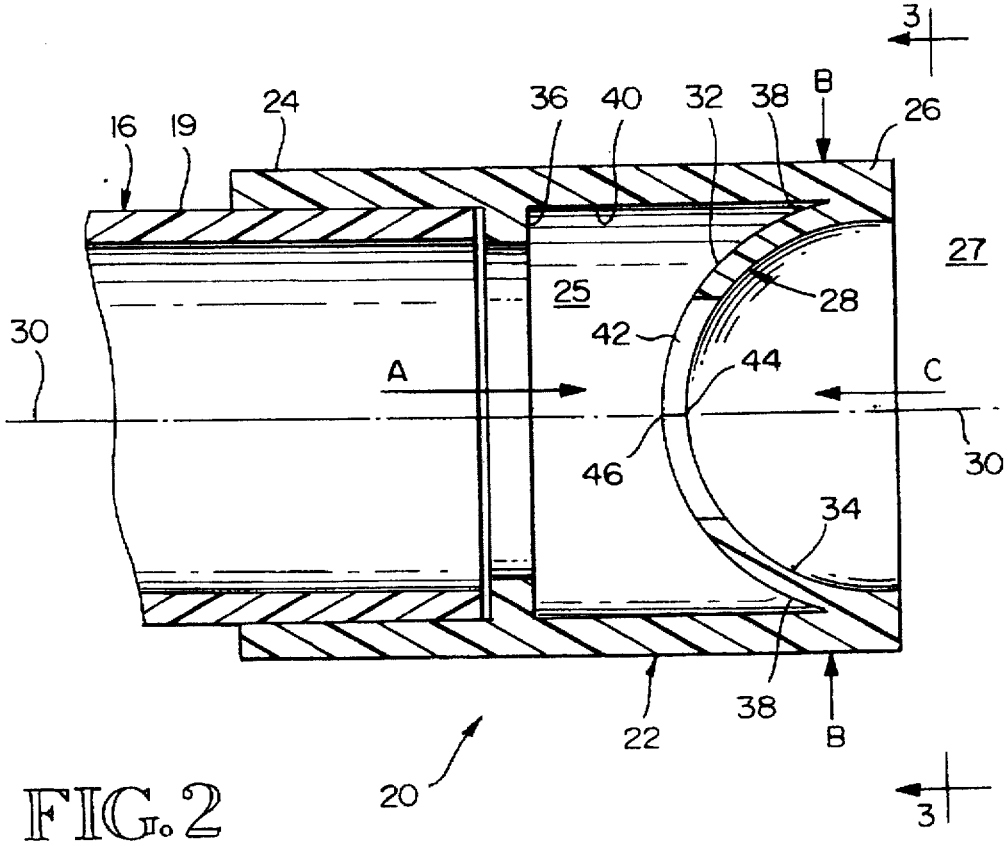
FIG. 2

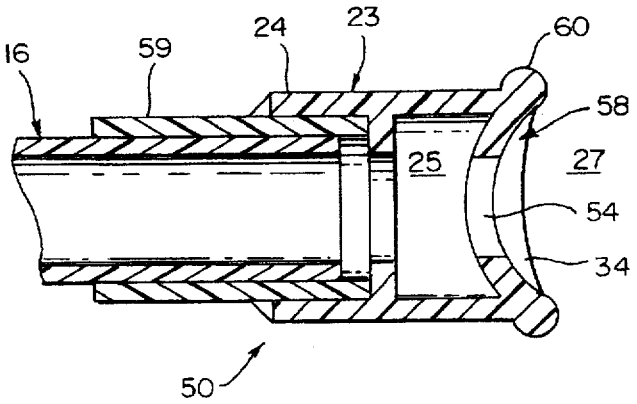
FIG. 8
FIG. 9
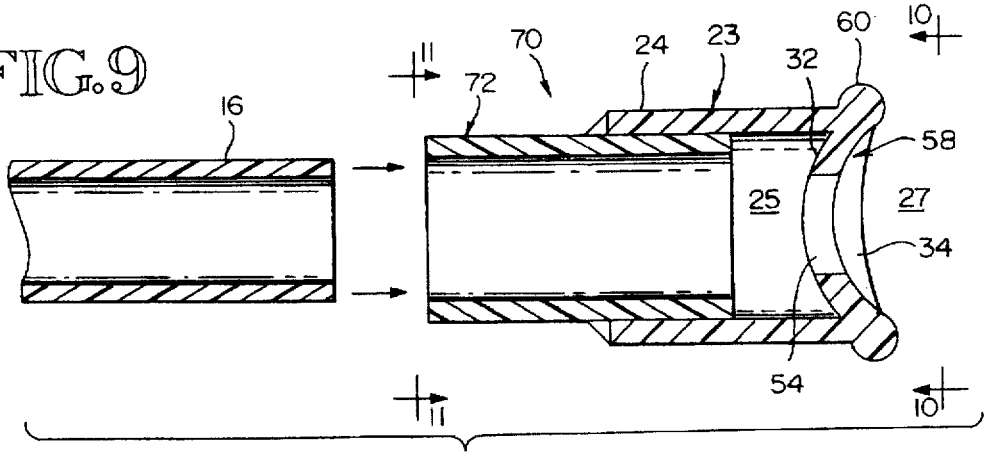
FIG. 10
FIG. 12
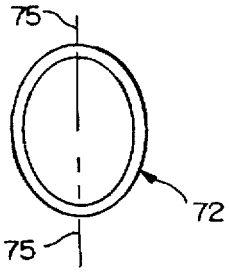
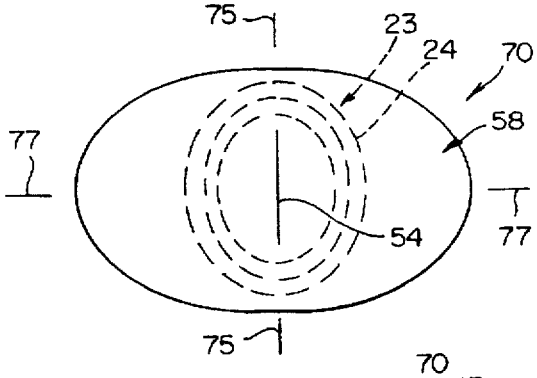
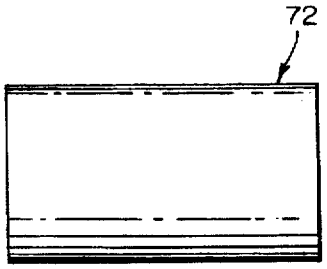
FIG. 13
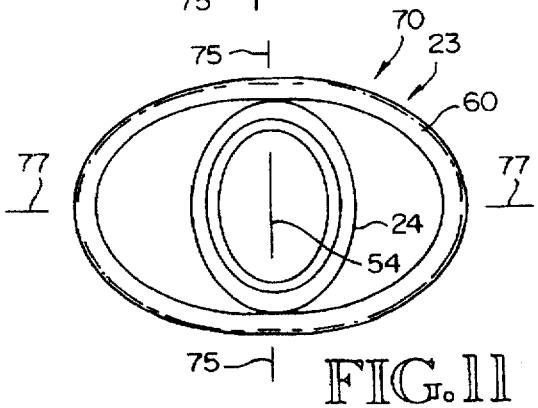
FIG. 11

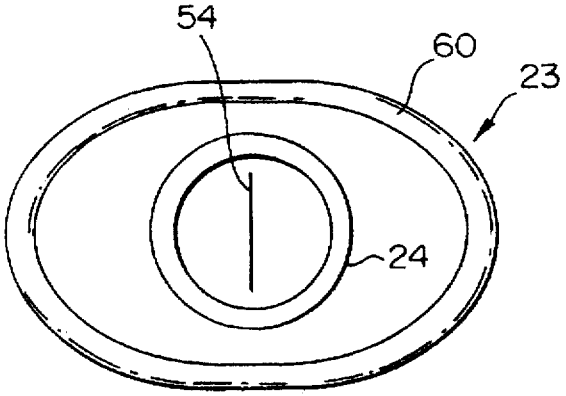
FIG. 14
FIG. 15
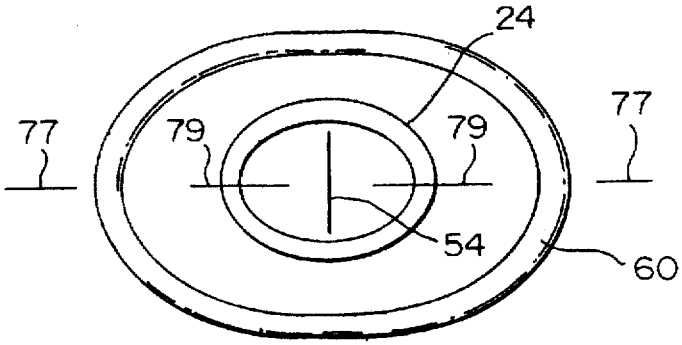

DISPENSING VALVE FOR A FLEXIBLE LIQUID CONTAINER

CROSS REFERENCE TO PRIOR APPLICATIONS

This application is a continuation-in-part of application Ser. No. 08/581,990, filed Jan. 2, 1996, now abandoned.

BACKGROUND OF THE INVENTION

The present invention relates in general to liquid dispensing valves. It relates in particular to a mouth-operated liquid dispensing valve for a flexible liquid-container.

Flexible liquid containers are extensively used in recreational and sporting activities for carrying supplies of water or nourishing fluids often referred to as sports-drinks. Such containers may be adapted to be carried on the person of someone engaged in a sporting activity such as cycling or mountain climbing, or, in larger capacity arrangements, may be simply used as storage reservoirs.

An important component of such a container, particularly a container which is used during a sporting activity, is a valve which allows a user to drink liquid instantly from the container, as needed, while providing a liquid tight seal for the container while not in use. The container may be pressurized for providing a force for expelling liquid through the valve while it is opened, or may be carried on a user's person at a height above the valve, such that a pressure head equal to the height difference between the container and the valve provides the expelling-force for the liquid.

Such a container is often used by a user to drink liquid without pausing from the activity in which he or she is engaged. As the type of activity engaged in is typically strenuous, it is important that the valve be operable with the minimum of force and conscious effort by the user.

A relatively simple valve is disclosed in U.S. Pat. No. 5,085,349. The valve comprises a body in the form of a tube having two flattened (opposite) sides, forming a racetrack like cross-section, and having inlet and outlet ends. A plug proximate the outlet end of the tube has an elongated slit therein, the slit extending generally perpendicular to the flattened sides. A user operates the valve by compressing the flattened sides of the tube together, thereby distorting and opening the slit to allow liquid to be expelled into the user's mouth.

While clearly a simple arrangement, not having any moving parts, this valve has certain shortcomings. A user, in order to operate the valve in an optimum manner, must ensure that the valve is oriented in his or her mouth with the flattened sides of the valve pressed against the lips. This may require a conscious effort on the part of a user, thereby distracting the user from the activity at hand.

In order that the valve remain closed when not in use the plug is given a substantial central thickness which extends the surface area of the slit therein. This added thickness may require that a significant physical force be applied by a user's lips to operate the valve. This required force may adversely affect the user's breathing. Distraction or impaired breathing would be particularly annoying during a competitive activity.

SUMMARY OF THE INVENTION

The present invention is directed to a dispensing valve for a flexible liquid-container. The valve is preferably operable by a user without pausing from any activity in which he or she is engaged, and preferably operable without conscious effort or inordinate force.

The above and other objects of the present invention are accomplished in a valve comprising an elongated hollow body formed from a resilient material and having a longitudinal axis. A diaphragm, located transverse to the longitudinal axis, defines an inlet side and an outlet side of the valve. The diaphragm has a generally convex surface and an opposite, generally concave surface and is arranged with the generally convex surface facing the inlet side of the valve. The diaphragm has at least one elongated slit extending therethrough.

In one preferred embodiment of the present invention, the diaphragm is bowl-shaped and has two intersecting slits extending therethrough. The slits are arranged such that the intersection of the slits is about on the cylindrical axis of the body.

Preferably the slits are radially-symmetrically disposed about the cylindrical axis of the body. In one preferred arrangement, the slits intersect at about ninety degrees to each other.

In another preferred embodiment of the present invention, the diaphragm is trough-shaped and has at least one slit extending therethrough. When two or more slits extend through the diaphragm, the slits are arranged such that they are symmetrically disposed about the cylindrical axis of the body In one aspect of the present invention, the bowl-shape or trough-shape of the diaphragm, oriented as described, provides for significant strength to resist distortionby any pressure from within the liquid container. Symmetrical arrangement of the slits about the cylindrical axis of the body provides that pressure from within the liquid container is applied equally along the slits to force the slits closed, thereby providing an effective seal for the container. In another aspect of the present invention, relatively thin walls of the diaphragm, combined with the symmetrical arrangement of the diaphragm, ensure that it is easily distorted by relatively small applied pressure. These aspects of the present invention provide that it may be operated by a user without conscious effort and with insignificant physical effort.

In yet another aspect of the present invention a bowl-shaped or trough shaped diaphragm is easily deformable by gas pressure applied thereon from the outlet end thereof. This provides that a container to which the valve is connected may be pressurized by a user blowing through the valve from the outlet end thereof.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

FIG. 1 is an elevation view schematically illustrating a prior art flexible liquid container including a tube for connecting the container to a dispensing valve.

FIG. 2 is a longitudinal cross-section view schematically illustrating one embodiment of a valve in accordance with the present invention, including a tubular body, connectable to the tube of FIG. 1, and having a bowl-shaped diaphragm therein.

FIG. 8 is a longitudinal cross-section showing an alternate arrangement of the valve of FIG. 6 including an extension tube for connecting the valve to the container-connecting tube of FIG. 1.

FIG. 9 is a longitudinal cross-section showing another alternate arrangement of the valve of FIG. 6 including an elliptical tube-spring tube for exerting longitudinal stress on the centrally located slit of the valve diaphragm.

FIG. 10 is an end elevation view of the valve of FIG. 9, seen generally in the direction 10—10 of FIG. 9.

FIG. 11 is an end elevation view of the valve of FIG. 9, seen generally in the direction 11—11 of FIG. 9.

FIG. 12 is an end elevation view of the tube-spring in the valve of FIG. 9.

FIG. 13 is a side elevation view of the tube-spring in the valve of FIG. 9.

FIG. 14 is an end elevation view seen generally in the direction 11 of FIG. 9, schematically illustrating an inlet end of the valve of FIG. 9, the inlet end having a generally circular cross-section.

FIG. 15 is an end elevation view seen generally in the direction 11 of FIG. 9, schematically illustrating an inlet end of the valve of FIG. 9, the inlet end having a generally ellptical cross-section.

DETAILED DESCRIPTION OF THE INVENTION

Figure 3:
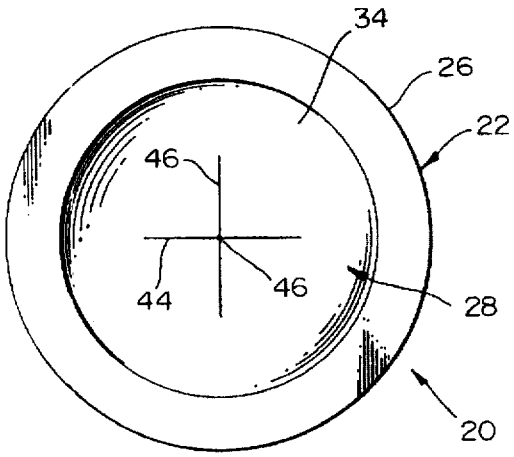
FIG. 3 is an end elevation view, seen generally in the direction 3—3 of FIG. 2 schematically illustrating a slit arrangement in the diaphragm of FIG. 2.
Figure 4:
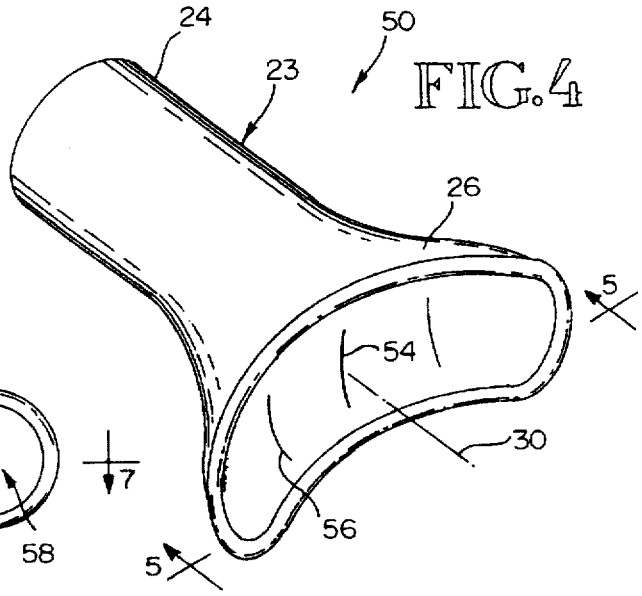
FIG. 4 is a perspective view schematically illustrating another embodiment of a valve in accordance with the present invention including a tubular body connectable to the tube of FIG. 1, and having a trough-shaped diaphragm therein, including a centrally located slit extending along the width of the trough.
Figure 5:
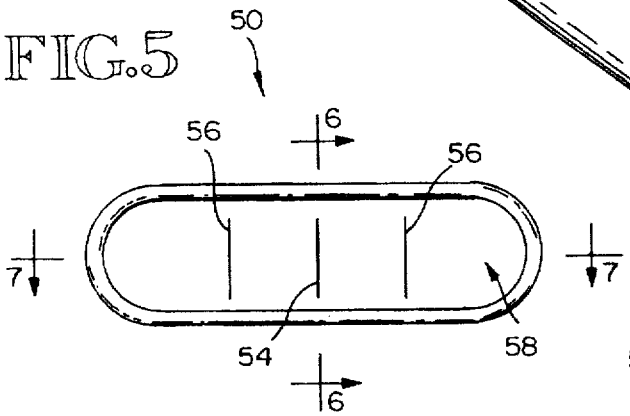
FIG. 5 is an end elevation view of the valve of FIG. 4, seen generally in the direction 5—5 of FIG. 4.
Figure 6:
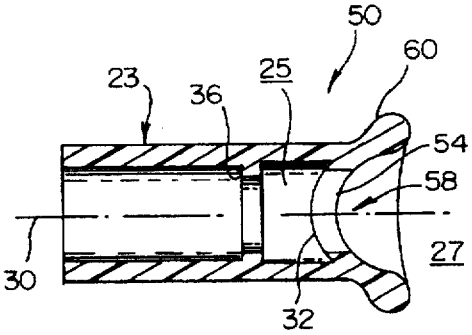
FIG. 6 is a longitudinal cross-section view of the valve of FIG. 4, seen generally in the direction 6—6 of FIG. 5.
Figure 7:
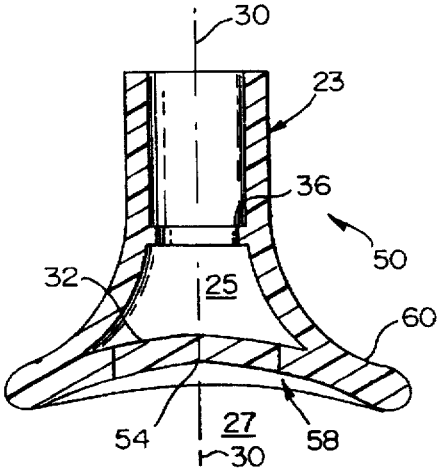
FIG. 7 is a longitudinal cross section view of the valve of FIG. 4 seen generally in the direction 7—7 of FIG. 5.

Turning now to the drawings, wherein like components are designated by like reference numerals, FIG. 1 depicts one example of a flexible-container liquid dispensing system 10, configured to be carried on a users's back. The system includes a flexible or collapsible container 12 having a filler cap 14, and elongated flexible tubing 16 in fluid communication at one end 18 thereof with container 12. Typically a dispensing valve (not shown) is connected to tubing 16 at opposite end 19 thereof.

Referring now to FIG. 2 and FIG. 3 a preferred embodiment 20 of a dispensing valve in accordance with the present invention includes a hollow cylindrical body 22 of a resilient material, preferably an elastomer material, and having an annular cross section. Body 22 has an inlet end 24 and an outlet end 26. Inlet end 24 is configured to receive tubing 16 for connecting valve 20 with a liquid-container. It should be noted here that body 22 could be of such a length that it would be directly connectable with a container without the need for tubing 16.

Within body 22, and proximate outlet end 26, thereof is a bowl-shaped diaphragm 28, also of a resilient material. Diaphragm 28 preferably has a thickness between about one twentieth and one fifth of the maximum circumference of the diaphragm.

Diaphragm 28 is arranged coaxially with body 22 on cylindrical axis 30 thereof. Diaphragm 28 has a convex surface 32 facing inlet end 24 of body 22, and a concave surface 34 facing outlet end 26 of body 22. In more general terms, diaphragm 28 can be characterized as defining a fluid inlet side 25 and a fluid outlet side 27 of valve 20. Convex surface 32 faces the inlet side of the valve, and concave surface 34 faces the outlet side of the valve. Diaphragm 28 is sealed around circumference 38 thereof to inner wall 40 of body 22. Preferably body 22 includes an inwardly-extending, annular stop-member 36 which prevents tubing 16 from being pushed into contact with diaphragm 28.

Extending through diaphragm 28 are intersecting slits 42 and 44. Slits 42 and 44 preferably have a length no greater than eighty percent of the maximum circumference of diaphragm 28. Slits 42 and 44 are shown in FIG. 2, for purposes of illustration only, as having a finite width. Preferably the each slit is formed in diaphragm 28 by incision with a sharp blade. As such the slits do not have a truly finite width, enabling sides of the slit to remain in close contact when diaphragm 28 is not distorted.

Slits 42 and 44 preferably intersect at a point 46 on cylindrical axis 30. Preferably slits 42 and 44 intersect at about ninety degrees with each other and are thus radially symmetrically disposed about cylindrical axis 30. It should be noted here that a valve in accordance with the present invention may function to a greater or lesser degree if more than two intersecting slits are provided in diaphragm 28. Whatever number of intersecting slits are provided, however, the invention will function optimally when the slits intersect at a common point on cylindrical axis 30 and are radially symmetrically disposed thereabout.

Pressure applied to diaphragm 28 from within a container to which it is attached, i.e., pressure applied in the direction indicated in FIG. 2 by arrow A, will cause bowl-shaped diaphragm 28 to be in compression, resisting the applied force. With slits 42 and 44 arranged radially symmetrically, as illustrated, compressire force will be applied symmetrically along the slits forcing and maintaining the slits closed while maintaining the slits in their original form. Thus fluid can not escape through the slits in the absence of any other force applied, directly or indirectly, to diaphragm 28.

A relatively-small transversely-applied force applied to diametrically opposite points of body 22 (indicated in FIG. 2 by arrows B), and thus indirectly to diaphragm 28, will distort body 22, diaphragm 28 and slits 42 and 44 therein, thereby opening the slits and allowing fluid to be expelled from the container. The relatively small transverse force may be applied at any two roughly opposite points about the circumference of body 22 to open slits 42 and 44 in diaphragm 28. A user thus does not need to ensure any particular orientation of the tube in his or her mouth to operate the valve.

While an objective definition of a relatively-small force is not presented herein, such a force may be subjectively appreciated by the knowledge that a prototype of valve 20 was constructedby forming diaphragm 28 from a baby-bottle teat, and sealing the diaphragm in one-half inch diameter poly-urethane tubing having a wall thickness of about one-sixteenth inch. Clearly, such a construction method would not be appropriate for commercial production. In this regard, the simple form of the valve of the present invention makes it readily manufacturable as a single unit, with diaphragm 28 an integral part of that unit, by injection molding a resilient plastic or elastomer such as poly-urethane or PVC An interesting and useful aspect of the present invention is that while bowl-shaped diaphragm 28 is resistant to force applied uniformly and symmetrically to the convex surface 32 thereof, force applied, even uniformly and symmetrically, to concave surface 34 thereof (indicated in FIG. 2 by arrow C) will force open slits 42 and 44. This provides that valve 20 may be used not only as a dispensing valve allowing liquid therethrough to be expelled by fluid pressure from within a container to which it is attached, but may also be used as an pressurizing valve for pressurizing that container. Pressurizing the container may be done for assisting the expulsion of liquid therefrom when valve 20 is opened, or for maintaining the shape of the container. Force C may be providedby a user simply blowing into valve 20 at outlet end 26 thereof, or by using a mechanical pump device and an appropriately configured adaptor.

Referring now to FIGS. 4, 5, 6, and 7, another embodiment 50 of a valve in accordance with the present invention is illustrated. Here, a diaphragm 58 defines inlet side 25 and an outlet side 27 of the valve (see FIGS. 5 and 6). Diaphragm 58 has an elongated trough-shape rather than a bowl-shape as is the case for diaphragm 28 of valve 20. Nevertheless, in common with diaphragm 28, diaphragm 58 has a convex surface 32 and a concave surface 34 facing inlet and outlet sides 25 and 27 respectively of the valve. It should be noted here that the term trough-shaped as used in this description an appended claims is intended to encompass circumferential shapes of diaphragm 58 including elliptical, or rounded-end rectangular.

Generally cylindrical body 23 of valve 50 has an annular cross-section at inlet end 24 thereof for receiving tube 16. Outlet end 26 of generally cylindrical body 23 has a cross-section configured to correspond to the trough-shape of diaphragm 58. Diaphragm 58 is sealed to outlet end 26 of body 22.

Diaphragm 58 has at least one slit 54 extending therethrough for allowing the passage of fluid when the valve is operated by a user. Slit 54 has about the same width as slits 42 and 44 described above. Slit 54 is preferably oriented transversely, i.e., across the width of the diaphragm and preferably has a length no greater than about eighty percent of the width of the diaphragm. An advantage of valve 50 compared with valve 20 is that higher liquid throughput is possible. This higher throughput may be obtained by providing additional slits 56 extending through diaphragm 58. Where more than one slit extends through diaphragm 58 it is preferable that the slits be generally parallel to each other and bilaterally symmetrically disposed about cylindrical (longitudinal) axis 30 of the valve. Slits 54 and 56 preferably are formed in the manner described above for valve 20 and do not have a truly finite width.

Valve 50, including a trough-shaped diaphragm 58, may be operated by a user with as little physical effort as valve 20. Clearly, however, valve 50 requires a specific orientation in a user's mouth to be optimally effective which is not the case with a valve 20. In this regard, it has been found preferable to include in trough-shaped diaphragm 58, a lip portion 60 extending therearound, and extending outwardly from body 23. Preferably diaphragm 28 has an overall width of about six-tenths of an inch, an overall length of about eight-tenths of an inch, and a thickness of about one twentieth of an inch.

Concave wall 34 of diaphragm 58 preferably has a radius of about one-half inch across the width of the diaphragm and a radius of about one inch along the length of the diaphragm. This provides a trough shape of generally ellipsoidal form, which, in the preferred dimensions discussed above, retains most of the strength attributes of a dome or bowl-shaped diagram.

Body 23 preferably has a uniform wall-thickness of about one-twentieth of an inch and lip portion 60 extending around the diaphragm is in the form of a bead having a radius of about eight-hundredths of an inch and extending beyond body 23 by about this radius. It has been determined that when such a lip portion 60 is provided, and when the diaphragm and the lip have about the preferred dimensions, the action of a user's mouth closing on the valve, provided tube 16 is sufficiently flexible, will correctly orient the valve in the users mouth. Lip portion 60 also provides additional leverage for distorting diaphragm 58 for opening slits 54 and 56 therein. Lip portion 60 also provides that valve 50 can be retained in a user's mouth without any significant effort during use on the part of the user.

Referring now to FIG. 8, another preferred construction of valve 50 is shown. Here, body 23 has an extension tube 59 permanently, fixedly secured, for example, by welding, into inlet end 24 thereof. Extension tube 59 is sized to fit over connecting tube 16 in a fluid-tight, friction close fit, of sufficient integrity that valve 50 will remain attached to tube 16 during normal use, but can be pried free of the tube when it is desired to connect the tube to another apparatus such as a water filter.

Referring now to FIGS. 9–15 yet another now with embodiment 70 of a valve in accordance with the present invention is illustrated. Valve 70 is similar in all respects to above-discussed valve 50, with the exception that extension tube 59 of valve 50 is replacedby a tube spring 72. Trough shaped diaphragm 58 of valve 70 preferably includes only a central slit 54 oriented across the width of the diaphragm 58 (transverse to the length of the diaphragm 58) but may be furnished with similarly oriented slits as discussed above.

Tube-spring 72 is cylindrical and preferably generally elliptical in cross-section, the elliptical cross-section having a major axis 75 (see FIGS. 12 and 13). Tube-spring 72 is preferably made of a resilient material, preferably an elastomer material, which is stiffer, i.e, has a higher durometer value, than the material of body 23 of valve 70. It should be noted here that the term generally elliptical, as applied to the cross-section shape of tube spring 72, is intended to include shapes such as a rounded-end rectangle which are not strictly elliptical but can generally be described as having a major (length) axis and a minor (width) axis. A truly elliptical cross-section for tube spring 72 is preferred.

Tube-spring 72 is inserted into end 24 of valve-body 23 with major axis 75 substantially aligned with slit 54 in diaphragm 58 (see FIGS. 10 and 11). End 24 of body 23 is preferably arranged to have a generally circular cross section when tube-spring 72 is not inserted therein (see FIG. 14), the circular cross section having a diameter less than the major axis length of tube spring 72. Because of this, tube-spring 72 must be compressed in the direction of major axis 75 in order that it can be inserted into end 24 of valve-body 23. Once inserted and compression being released, tube-spring 72 expands in the direction of major axis forcing end 24 to assume an elliptical cross-section shape, thereby exerting tension on diaphragm 58 in a direction generally aligned with slit 54, the tension causing the slit to remain closed. It will be evident that end 24 of body 23 could also have a generally elliptical cross-section (see FIG. 15) provided that cross-section had a major axis 79 aligned with the length axis 77 of trough-shaped diaphragm 58, and a minor axis less length less than the major axis length of tube-spring 72.

Valve 70 may be connected to connecting tube 16 either by inserting connecting tube 16 into tube-spring 72 as illustrated in FIG. 9 (if tube 16 has an external circumference equal to the internal circumference of tube-spring 72), or (if connecting tube 16 has an internal circumference about equal to the external circumference of tube spring 72) by sleeving connecting tube 16 over tub-spring 72. Preferably connecting tube 16 is made of a material less stiff than the material of tube-spring 72, thereby allowing the tube to conform to the generally elliptical shape of the tube-spring.

Tension appliedby tube spring 72 is sufficiently effective in keeping slit 54 closed that the slit can be made, if desired, to extend across essentially the entire width of diaphragm 58. The longer slit 54, the higher the fluid flow rate therethrough when valve 70 is operated by a user. It is believed that even with a single slit 54 in diaphragm 58, fluid flow through valve 70 would be greater than flow through prior art valves for the same purpose.

The present invention has been described and depicted in terms of a preferred and other embodiments. The invention is not limited, however, to the embodiments described and depicted. Rather the invention is defined by the claims appended hereto.

What is claimed is:

1. A valve for a liquid container comprising:

an elongated hollow body formed from a resilient material, said body having an inlet end, an outlet end with a peripheral portion and a longitudinal axis, and defining a lip portion located substantially at said outlet end wherein said lip portion extends uniformly outwardly from said outlet end peripheral portion of said hollow body; and a diaphragm of a resilient material, said diaphragm having a generally convex surface and an opposite, generally concave surface and defining at least one elongated slit extending therethrough, wherein said diaphragm is located transverse to said longitudinal axis, and defines an inlet side and an outlet side of the valve, and wherein said diaphragm is positioned with said generally convex surface facing said inlet side of the valve.

2. The valve of claim 1, wherein said elongated body is a tubular body and said diaphragm is bowl-shaped and has two elongated slits extending therethrough, said slits intersecting each other at a point located about on said longitudinal axis.

3. The valve of claim 1, wherein said diaphragm is trough-shaped.

4. The valve of claim 3 wherein said diaphragm has at least two elongated slits extending therethrough, said slits being parallel to each other and arranged symmetrically about said longitudinal axis.

5. A valve for a liquid container comprising:

a hollow cylindrical body, said hollow cylindrical body formed from a resilient material, said body having an annular cross section, a cylindrical axis, an inlet end, an outlet end with a peripheral portion, and an inner wall, and defining a lip portion located substantially at said outlet end wherein lip portion extends uniformly outwardly from said outlet end peripheral portion of said hollow body; and a bowl-shaped diaphragm formed from a resilient material, said diaphragm being coaxially located within said body proximate said outlet end and circumferentially sealed to said inner wall, and defining two intersecting slits extending therethrough, said slits arranged such that the intersection of said slits is about on said cylindrical axis; wherein said diaphragm has a convex surface facing said inlet end of said body and a concave surface facing said outlet end of said body.

6. The valve of claim 5, wherein said intersecting slits are radially symmetrically disposed about said cylindrical axis.

7. The valve of claim 5 wherein said slits intersect at an angle of about ninety degrees to each other.

8. The valve of claim 5 wherein said inlet end of said hollow cylindrical body is configured to accept a connecting tube for connecting said valve to said liquid container.

9. The valve of claim 5 wherein said hollow cylindrical body is directly connectable to said container.

10. The valve of claim 5 wherein said diaphragm is an integral part of said hollow cylindrical body.

11. A valve for a liquid container comprising:

an elongated, hollow body having a longitudinal axis, an inlet end, an outlet end with a peripheral portion, and defining a lip portion located substantially at said outlet end wherein said lip portion extends uniformly outwardly from said outlet end peripheral portion of said hollow body; and an elongated trough-shaped diaphragm having a generally convex surface and an opposite generally concave surface, said diaphragm defining an inlet side and an outlet side of the valve and positioned with said generally convex surface toward said inlet side, and defining at least one elongated slit extending therethrough.

12. The valve of claim 11 wherein said inlet end of said hollow body is cylindrical in cross-section and configured to accept a connecting tube for connecting said valve to said liquid container.

13. The valve of claim 12 wherein said outlet end of said body has a cross-section configured to correspond to the shape of said diaphragm, and said diaphragm is sealed to said outlet end of said body.

14. The valve of claim 11 having at least two slits extending therethrough, said slits generally parallel to each other and symmetrically disposed about said longitudinal axis.

15. The valve of claim 12, wherein said body is formed from a first resilient elastomer material, said at least one slit is located centrally in said diaphragm and extends in a direction transverse to the length of said diaphragm, and further including means within said body for exerting tension on said diaphragm, said tension exerted in a direction generally aligned with said at least one slit.

16. The valve of claim 15, wherein said tension applying means comprises a cylindrical member having a generally elliptical cross-section, said cross section having a major axis, and said cylindrical member being formed from a second resilient material stiffer than said first resilient elastomer material and said cylindrical being inserted into said inlet end of said body with said major axis substantially aligned with said at least one slit, thereby causing said inlet end of said body to assume an elliptical cross section.

* * * * *